United States Patent [19]

Samuelian

[11] 4,262,780

[45] Apr. 21, 1981

[54] FIXTURE FOR CONVERTING LUGGAGE FOR ARTICULATED MOVEMENT

[76] Inventor: Richard W. Samuelian, 521 W. Morris Ave., Fresno, Calif. 93704

[21] Appl. No.: 100,488

[22] Filed: Dec. 5, 1979

[51] Int. Cl.[3] ..... A45C 5/14

[52] U.S. Cl. ..... 190/18 A; 16/29; 280/47.34

[58] Field of Search ..... 190/18 A, 18 R; 280/47.34, 47.26, 47.24, 47.17, 79.1 R, 79.2; 16/29, 31 R, 31 A; 403/75

[56] References Cited

U.S. PATENT DOCUMENTS

| | | | |
|---|---|---|---|
| 2,543,697 | 2/1951 | Lanter | 16/29 X |
| 2,689,631 | 9/1954 | Marks | 190/18 R |
| 4,126,213 | 11/1978 | McDonald | 190/18 A |

FOREIGN PATENT DOCUMENTS

| | | | |
|---|---|---|---|
| 696845 | 10/1965 | Italy | 190/18 A |
| 676355 | 7/1952 | United Kingdom | 280/79.1 R |
| 787918 | 12/1957 | United Kingdom | 16/29 |

*Primary Examiner*—Donald F. Norton
*Attorney, Agent, or Firm*—Huebner & Worrel

[57] ABSTRACT

A fixture for luggage which has a flexible outer casing housing independent bottom and end panels disposed in substantially right angular relation to each other, the fixture having a base plate adapted to be mounted on the casing in fixed relation to the bottom panel adjacent to the end panel; a mounting plate borne by the base plate in upstanding relation; and a pivot assembly secured on the mounting plate and adapted to mount the end panel for pivotal movement about an axis substantially parallel to the bottom panel.

1 Claim, 7 Drawing Figures

FIXTURE FOR CONVERTING LUGGAGE FOR ARTICULATED MOVEMENT

BACKGROUND OF THE INVENTION

1. Field Of The Invention

The present invention relates to a fixture for converting luggage for articulated movement and more particularly to such a fixture which can be employed to convert luggage for self-supporting earth traversing movement while imparting a stability to the luggage during such movement which facilitates self-supporting transport thereof.

2. Description Of The Prior Art

It has been known to attach a variety of types of earth transporting mechanisms to luggage to provide them with the capability for self-supporting earth transport. Such luggage can then be pulled along in rested engagement with a supporting surface rather than be carried. Thus, it has been known to attach wheels, rollers, ball bearings, and the like to luggage during manufacture. It has also been known to install wheels on existing luggage to convert them to such use.

However, certain difficulties have arisen with luggage of the semi-flexible type. Luggage of this type possesses a number of advantages over the more rigid conventional luggage, but has been found less than satisfactory for wheel transport because of the propensity for the luggage to sag and to fall over when not supported by the handle. This problem is compounded as a result of the transfer of such sagging motion through the luggage to raise supporting wheels from ground engagement often causing the luggage to tip over. While this problem is particularly actute with luggage of the semi-flexible type, it also resides in other types of luggage.

Therefore, it has long been known that it would be desirable to have a fixture for luggage which is operable to provide a wheeled capability for luggage while imparting a stability during use not heretofore achievable.

SUMMARY OF THE INVENTION

Therefore, it is an object of the present invention to provide a fixture for luggage to impart a capability to the luggage for self-supporting earth traversing movement and which can be installed at the time of manufacture or, alternatively, installed on existing luggage to convert it to such use.

Another object is to provide such a fixture which affords a stability during wheeled transport not heretofore achieved.

Another object is to provide such a fixture which is particularly well suited to use on luggage of the semi-flexible type.

Another object is to provide such a fixture which can be installed on existing luggage to operate cooperatively with certain portions thereof to impart a stability during use.

Another object is to provide such a fixture for converting for articulated movement luggage having independent, substantially rigid bottom and upright panels retained in a semi-flexible outer casing.

Another object is to provide a fixture which has particular utility on luggage of the foldover type wherein a pair of flexible sections are disposed in side-by-side relation.

Another object is to provide such a fixture which facilitates replacement of mechanisms for wheeled transport without removal of the fixture itself from the luggage.

Another object is to provide such a fixture which affords the capability for wheeled transport, but which does not interfere with normal usage of the luggage.

Further objects and advantages are to provide improved elements and arrangements thereof in an apparatus for the purposes described which is dependable, economical, durable and fully effective in accomplishing its intended purposes.

DESCRIPTION OF THE PREFERRED EMBODIMENT

Figure 1:
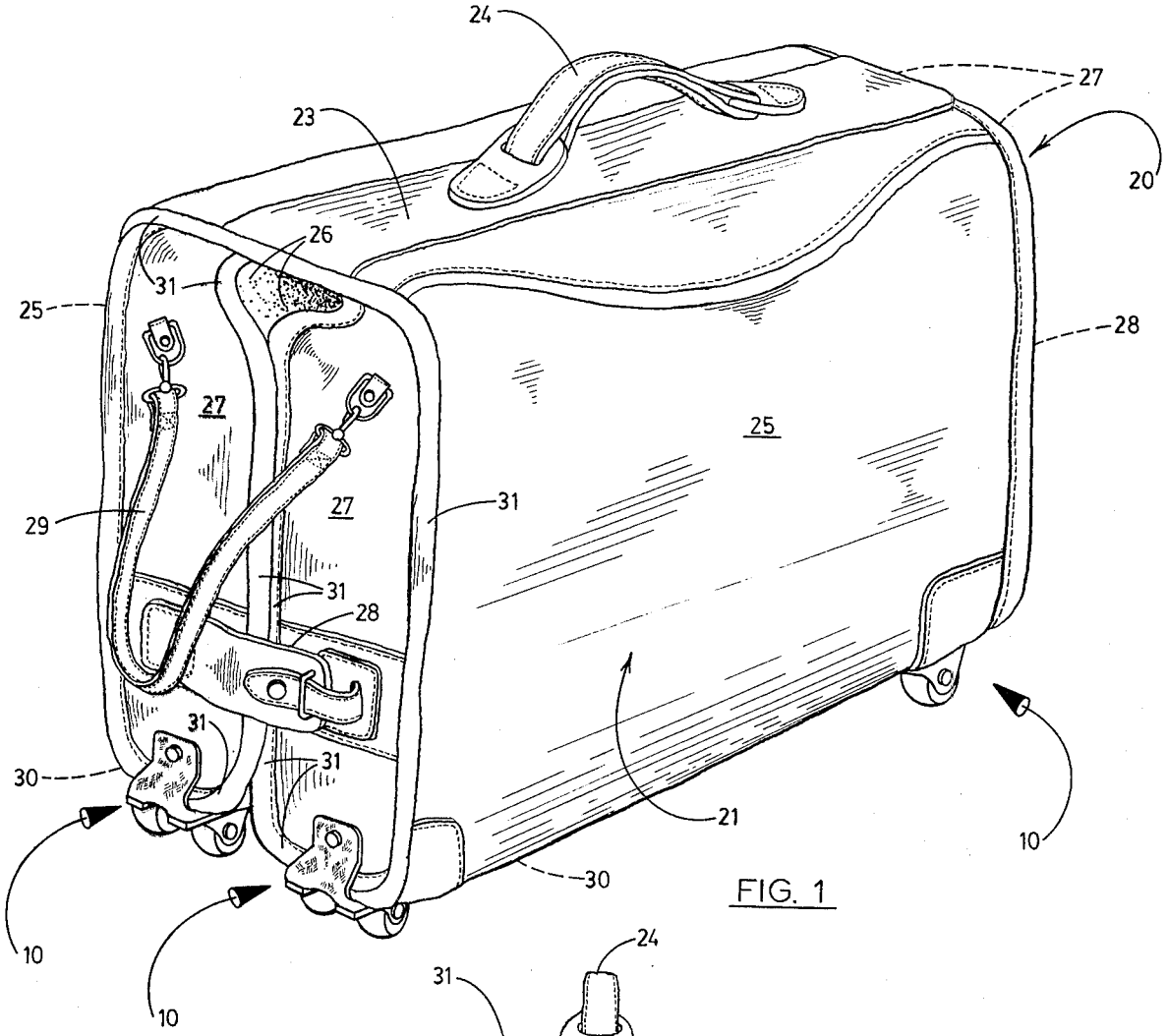
FIG. 1 is a perspective view of luggage mounting several of the fixtures of the present invention in a typical operative configuration.

Referring more particularly to the drawings, the fixture of the present invention is generally indicated by the numeral 10 in FIG. 1. As shown therein, four such fixtures are mounted on a piece of luggage 20. The fixture can be employed on luggage of a variety of types. For illustrative convenience, the luggage shown and described herein is of a common type. The luggage has a flexible outer casing or housing 21 which is foldable into a return bent configuration to form a pair of side-by-side sections 22. When disposed in this configuration, the casing of the luggage has a top portion 23 mounting a panel 24. The casing has a pair of outer side portions 25 and a pair of inner or facing side portions 26. Each section of the casing has a pair of opposite end portions 27. Corresponding end portions of the sections of the casing are interconnected by fastening assemblies 28 when the luggage is disposed in the configuration shown in FIG. 1. For the use permitted by the fixtures 10 of the present invention, a pull strap 29 is secured on and interconnects each section.

Figure 2:
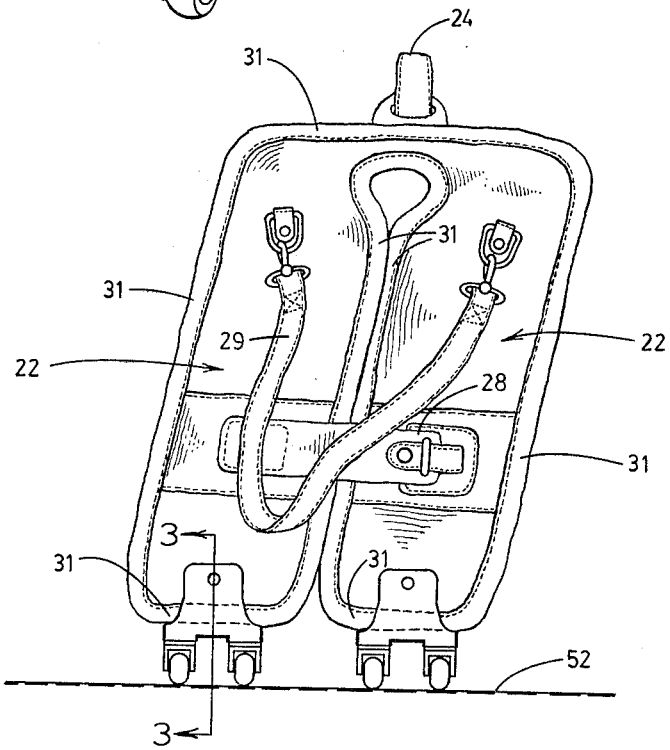
FIG. 2 is an end view of the luggage of FIG. 1 shown in an attitude illustrating operation of the fixture of the present invention.

Each section 22 of the casing 21 has a generally convex bottom portion 30. The top portion 23, outer side portions 25, inner side portions 26, opposite end portions 27 and bottom portions 30 are interconnected by endwardly extending ribs 31 at opposite ends of the luggage, as best shown in FIGS. 1 and 2. As is typically the case in luggage, the rib is relatively rigid and protrudes beyond the end portions of each section.

Figure 3:
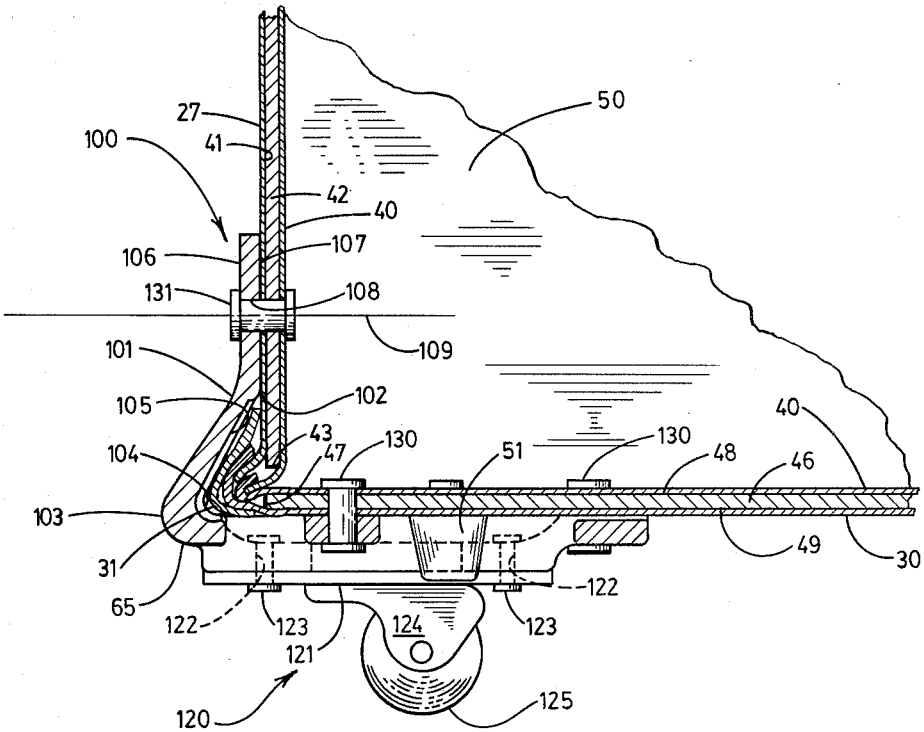
FIG. 3 is a somewhat enlarged fragmentary transverse vertical section of the fixture of the present invention as installed on the luggage viewed in FIGS. 1 and 2.

Each section 22 of the casing 21 has a pair of inner flexible panels 40 individually fastened in overlaying relation to one of the end portions 27 of the casing of that section within the luggage to define a pocket 41. An upright or end panel 42 of substantially rigid construction is received within each such pocket, as best shown in FIG. 3. Each end panel has a rounded lower edge 43, a pair of substantially parallel side edges 44 and a rounded upper edge 45.

Each section 22 of the casing 21 has a bottom panel 46 of substantially rigid construction secured in facing engagement with the bottom portion 30 of the casing 21 and having opposite ends 47 extending to positions beneath the end panels 42 of that section, as best shown in FIG. 3. An inner flexible panel 40 overlays the bottom panel 46 of each section and is fastened on the casing thus capturing the bottom panel in position in the casing. Each bottom panel has a substantially flat upper surface 48 and a substantially flat lower surface 49. It will be seen that although the end panels 42 of each section may rest on the upper surface 48 of their respective bottom panel adjacent the opposite ends 47 thereof, or more accurately on the inner flexible panel 40 thereof, the bottom panel and end panels are not interconnected or locked in relation to each other except insofar as the flexible outer casing retains them in substantially right angular relation to each other, as shown in FIG. 3. The outer casing 21 encloses and thus defines an interior 50 for the luggage. A pair of buttons or rests 51 are individually affixed on the bottom portion 30, bottom panel 46 and inner flexible panel 40 thereof for each section 22 in individual relative proximity to the opposite ends 47 of the bottom panel, as best shown in FIG. 3. In conventional use the rests are employed to support the luggage in upright relation on a supporting surface such as indicated at 52 in FIG. 2.

It will be understood that the luggage 20 as described to this point is of conventional construction and is illustrative of a type of luggage on which the fixture of the present invention can be employed. However, the fixture can also be installed on a variety of other types of luggage to obtain the use of its unique operative advantages.

Similarly, the fixture 10 of the present invention can be constructed in a variety of forms. The form of the invention shown and described herein is believed best suited for use on the particular type of luggage 20 heretofore described. However, it will be understood that other forms of construction can also be employed which may be more suited to a particular type of luggage without departing from the invention.

The fixture 10 has a bracket 60 which is preferably a single metal casting. The bracket has a base or base plate 61 having an upper surface 62 and a lower surface 63. The upper surface 62 has a central portion 64 extending longitudinally and centrally thereof from a first end portion 65 to a second end portion 66. The central portion has an opening 67 extending through the base plate in proximity to the first end portion 65 for reducing the weight of the fixture. A rivet hole 68 is extended through the central portion of the base plate on the opposite side of the strap opening 67 from the first end portion 65. An elongated rest opening 69 is provided in the central portion of the base plate between the rivet hole 68 and the second end portion 66. A channel or depression 70 is provided in the central portion of the upper surface 62 extending from the rest opening 69 to the second end portion 66. The channel is dimensioned to be fitted about a strap which is present on the bottom portion of certain brands of luggage and constitutes part of a hook assembly for supporting the luggage in an unfolded configuration. Receipt of such a strap in the channel permits the base plate securely to engage the bottom portion 30 of the luggage when installed.

The upper surface 62 of the bracket 60 has a pair of side portions 80 disposed on opposite sides of the central portion 64. Each side portion has an elongated receptacle or recess 81 extending into the bracket from the upper surface. An opening 82 is extended through the bracket within each recess 81. A pair of rivet holes 83 are individually extended through the bracket within each recess on opposite sides of the opening. The rivet hole 84 is provided in each side portion 80 immediately adjacent to the channel 70 of the central portion.

Figure 4:
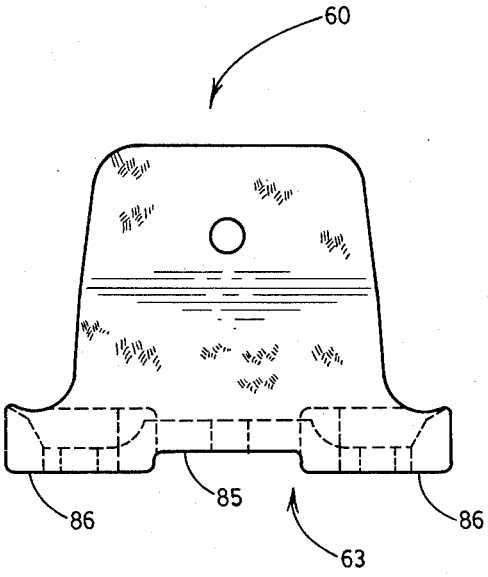
FIG. 4 is an end view of the bracket of the fixture of the present invention.
Figure 5:
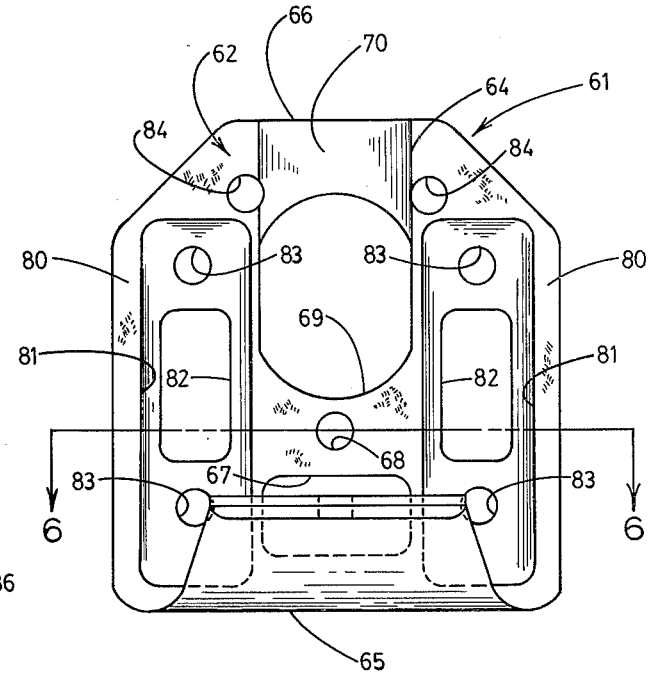
FIG. 5 is a top plan view of the bracket of FIG. 4.

The lower surface 63 of the bracket has a central channel 85 extending from the first end portion 65 of the base plate 61 to the second end portion 66. The channel 85 is bounded on opposite sides by a pair of downwardly extending wheel mounts 86, as best shown in FIG. 4. The upper surface 62 of the base plate has lateral shoulder 87 bounding the recesses 81. Thus, the upper surface of the base plate has a generally concave configuration adapted for fitted engagement with the generally convex bottom portion 30 of the flexible outer casing 21 of the luggage 20. Conversely, the lower surfaces 63 of the wheel mounts 86 of the base plate are substantially flat.

Figure 6:
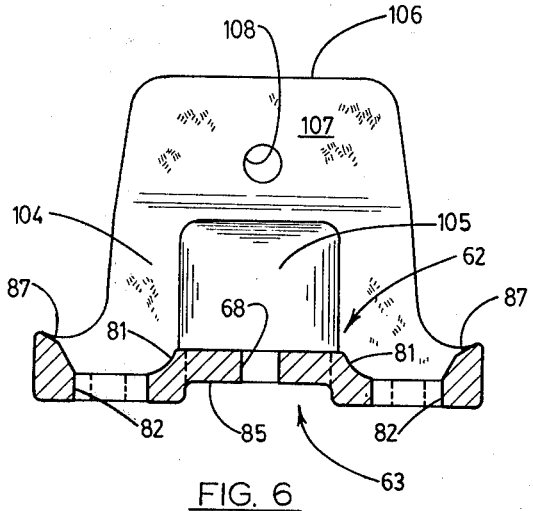
FIG. 6 is a transverse section taken on line 6—6 in FIG. 5.
Figure 7:
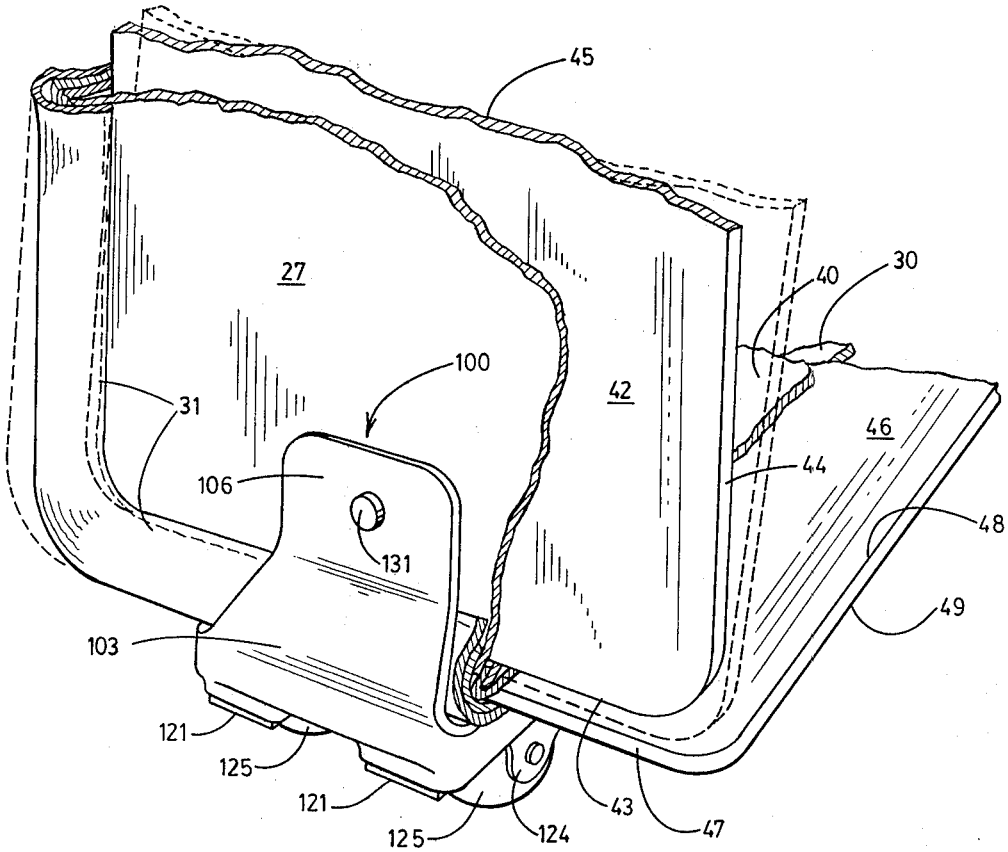
FIG. 7 is a fragmentary, diagrammatic perspective view illustrating the operation of the fixture of the present invention.

An upright plate or mount 100 is borne in upstanding relation on the base plate 61 extending along the first end portion 65 thereof. Where, as preferred, the bracket is a casting, it will be understood that the base plate and upright plate constitute a single integral casting. The upright plate has a outer surface 101 and an inner surface 102. The upright plate is curved, as best shown in FIG. 3, to form a protruding portion 103 in the outer surface and a channel 104 in the inner surface. A recess 105 is provided in the inner surface which is coextensive with a portion of the channel, as best shown in FIG. 6. The recess serves the purpose of minimizing the amount of material in the bracket and thus reducing its weight.

The upright plate 100 has a mount or flange portion 106 remote from the base plate 61 and having a flat surface 107 coestensive with the inner surface 102 of the upright plate. The flange portion is disposed at substantially right angles with respect to the base plate 61. A pivot hole 108 is extended through the flange portion substantially centrally thereof along the axis 109 substantially parallel to the base plate.

A pair of wheel assemblies 120 are individually mounted on the wheel mounts 86 on the lower surface 63 of the base plate 61 in spaced, substantially parallel relation. Each wheel assembly has a mounting plate 121 having a pair of rivet holes 122 extending therethrough in a pattern corresponding to the rivet holes 83 of the base plate. The mounting plates 121 of the wheel assemblies are secured on the wheel mounts of the base plate by rivets 123 extending through the rivet holes 122 and 83 firmly to secure the mounting plates in position on the wheel mounts. The receptacle or recess 81 permits the rivets 123 to be drilled out and the remnants of the rivets to be received in the receptacle, should replacement of a wheel assembly be necessary, so as not to require removal of the fixture from the luggage for this purpose. Each wheel assembly has a wheel mount 124 affixed on the mounting plate which can be either of a swivel type, a fixed type or any other suitable type. A wheel is borne by each wheel mount for rotational movement. As used in this patent application the word "wheel" includes all types of ground transporting mechanisms including wheels, rollers, ball bearings, and the like. Similarly, it will be seen that in certain uses it may be desirable to use a skid plate or the like instead of wheel assemblies. The fixture of the present invention is not limited to a ground transporting mechanism of any particular type.

As best shown in FIG. 3, the fixture 10 of the present invention is mounted in position on the luggage 20 by rivets 130 extending through the rivet holes 68 and 84 and extended through the bottom portion 30, bottom panel 46 and the inner flexible panel thereof for their respective section 22 of the casing 21.

A rivet or pivot assembly 131 is mounted on and extended through the pivot hole 108 of the flange portion 106 of the upright plate 100 and through the end portion 27 of the casing and end panel 42 received within the pocket 41.

When assembled in this manner, the rib 31 is slidably received within the channel 104 of the upright plate 100 the base plate 61 is secured in fixed relation relative to the bottom panel 46 and the end panel 42 is mounted for pivotal movement about the axis 109 within the range permitted by the flexibility of the end portion 27 of the flexible outer casing 21 of the luggage.

It will be understood that with the type of luggage shown in the drawings and described herein, four such fixtures 10 are secured in the described manner on the luggage 20 with one fixture at each end portion of each section 22. Preferably the fixtures at opposite ends of the same section 22 are aligned so that the axes 109 thereof are aligned and the end panels 42 are thus, in effect, pivotal about a common axis. It is preferred that the wheel mounts 124 of the wheel assemblies 120 at what would be the leading end of the luggage relative to the direction of travel be of the swivel type. Those wheel assemblies at the rearward end relative to the direction of travel are preferably of the fixed type. However, any desired combination can be employed.

OPERATION

The operation of the described embodiment of the subject invention is believed to be clearly apparent and is briefly summarized at this point. Mounting four fixtures 10 as heretofore described and as shown in FIG. 1, the luggage 20 can be pulled using the pull strap 29 or guided using the handle 24 along a supporting surface 52 without being carried.

In conventional use when the luggage 20 is packed and disposed in the attitude shown in FIG. 1, it tends to flex or sag under the weight of the contents. This makes the use of conventional wheel assemblies on such luggage very difficult if not impossible. However, when the luggage is fitted with the fixtures 10 of the present invention as described, the end panels 42 and bottom panels 46 of the luggage are converted for articulated movement relative to each other about the axes 109. It has been discovered that such articulated movement minimizes the detrimental effect of any tendency to sag by causing movement to be uniform and controlled. Thus, where the contents cause the sections 22 of the luggage 20 to tend to shift sidewardly as shown in FIG. 2, the end panels 42 are pivoted about their respective axes 109 tending to leave the bottom panels of the sections of the luggage parallel to the supporting surface 52. As a consequence, such action permits the wheels 125 of the wheel assemblies 120 to remain fully in engagement with the supporting surface 52 imparting stability to the luggage such as has not heretofore been achieved. As can best be visualized in FIG. 2, the axis 109 of each fixture tends to be retained in the position shown in FIG. 2 centered above the wheel assemblies of that fixture thereby substantially improving the stability of the luggage. The rib 31 received within the channel 104 of each upright plate slides within its respective channel during pivotal movement to guide such pivotal movement and to further reinforce the luggage.

As can best be visualized in FIG. 3, the fixtures of the present invention also permit the wheel assemblies to be mounted in close proximity to the ends of the luggage which minimizes the tendency for the luggage not to pass easily over such irregular surfaces such as curbs, steps and the like. Still further, it will be seen that the fixture does not interfere with the conventional rests 51 thereby avoiding the necessity of removing the rests to install the fixtures. In certain types of luggage, where straps or hooks are attached to the bottom portion 30 of one of the sections, the hook or strap is elevated above the supporting surface 52 by the wheel assemblies thereby avoiding interference with movement along the supporting surface.

Therefore, the fixture 10 of the present invention considerably improves the serviceability of luggage on which it is installed by providing the capability of self-supporting earth traversing movement without the problems heretofore encountered.

Although the invention has been herein shown and described in what is conceived to be the most practical and preferred embodiment, it is recognized that departures may be made therefrom within the scope of the invention, which is not to be limited to the illustrative details disclosed.

Having described my invention what I claim as new and desire to secure by Letters Patent is:

1. A fixture for converting for articulated movement luggage or the like, having flexible portions joined by a protruding, transversely extending rib and the flexible portions retaining independent substantially rigid bottom and upright panels in angular relation to each other, the fixture comprising a base having means for mounting the base on the luggage in fixed position relative to the bottom panel thereof; a mount affixed on the base in upstanding relation; and means borne by the mount for securing said upright panel of the luggage on the mount for pivotal movement about an axis substantially parallel to said bottom panel, the mount of the fixture having a channel extending transversely thereof between the base and said axis of movement of the upright panel and the channel dimensioned slidably to receive the rib to guide said movement of the upright panel.

* * * * *